United States Patent [19]

McWhorter

[11] 4,312,156

[45] Jan. 26, 1982

[54] APPARATUS FOR CRYOGENIC SHOT-BLASTING

[75] Inventor: Thomas E. McWhorter, Whitehall, Pa.

[73] Assignee: Air Products and Chemicals, Inc., Allentown, Pa.

[21] Appl. No.: 130,905

[22] Filed: Mar. 17, 1980

[51] Int. Cl.[3] ..... B24C 3/14; B24C 9/00

[52] U.S. Cl. ..... 51/418; 51/322; 62/266; 62/380

[58] Field of Search ..... 51/418, 426, 322; 62/378, 380, 381, 266, 64

[56] References Cited

U.S. PATENT DOCUMENTS

| | | | |
|---|---|---|---|
| 2,344,476 | 3/1944 | Turnbull | 51/418 |
| 2,510,927 | 6/1950 | Huyett | 51/418 X |
| 3,824,739 | 7/1974 | Moret | 51/418 |
| 3,871,185 | 3/1975 | Harper | 62/380 X |
| 4,121,387 | 10/1978 | Wers | 51/418 |
| 4,164,103 | 8/1979 | Hesse | 51/426 X |

FOREIGN PATENT DOCUMENTS

| | | | |
|---|---|---|---|
| 601608 | 2/1960 | Italy | 51/418 |

*Primary Examiner*—Nicholas P. Godici

*Attorney, Agent, or Firm*—E. Eugene Innis; Thomas G. Ryder; Richard A. Dannells, Jr.

[57] ABSTRACT

This invention is directed to an apparatus for subjecting an article to shot blasting under cryogenic conditions which comprises a housing encompassing an entry station, an impacting station and an exit station. In connection with the housing, there are means provided for transporting an article to be shot blasted sequentially from the entry station, through the impacting station, and then to the station. A connection is made to the housing permitting the introduction of a cryogen into the impacting station thereby maintaining such station at a cryogenic temperature. The apparatus also has a means for directing media at a high velocity so as to impact upon an article to be treated while such article is being transported through the impacting station. The apparatus of the invention also functions to rotate the article while it is being transported through the impacting station, thereby permitting the stream of media to contact all critical portions of the article.

11 Claims, 10 Drawing Figures

APPARATUS FOR CRYOGENIC SHOT-BLASTING

The present invention is directed to a cryogenic shot blasting apparatus. More particularly, this invention is directed to a cryogenic shot blasting apparatus specifically adapted for the processing of relatively large articles, relatively heavy articles and/or articles having relatively delicate extremities. The present invention is also adapted to accomplish this end in a continuous operation.

Cryogenic deflashing operations have been previously employed for the removal of flash from molded plastic and rubber articles or for the removal of paint or coatings from various articles. This technique, however, has previously been applied only to relatively small parts or pieces, such as O-rings, bushings and other items generally small enough to be held in the palm of the hand. The technique usually comprises contacting the piece with a cryogen, such as nitrogen either in the liquid or gaseous state, in order to reduce the temperature of the piece to a point where the relatively thin flash is embrittled, while the main body of the piece may not be embrittled due to its greater bulk. Similarly, coated articles have been contacted with a cryogen so as to embrittle the coating or lessen the bonding strength of the coating to the article. Thereafter, the piece with the now cryogenically embrittled flash or coating is impacted with a high velocity stream of deflashing media. Typical of such media are pelletized steel, or plastic shot.

A typical apparatus for accomplishing this result operates in a batch or semi-batch mode wherein the pieces to be treated were introduced into an insulated chamber containing an endless belt designed to cause the pieces to tumble upon each other when the belt is activated. The pieces within the insulated chamber were then subjected to contacting with a cryogen in order to embrittle the flash on the pieces and thereafter a high velocity stream of the deflashing media is directed onto the tumbling mass of pieces. After a suitable period of operation, the introduction of cryogen and the impacting with shot were discontinued. The then deflashed pieces could be recovered from the deflashing chamber.

When dealing with pieces to be treated that are greater than a certain size or when the piece to be deflashed contains components of a substantially greater density than the plastic or rubber to be deflashed, the tumbling technique, which is quite satisfactory with small parts, no longer is feasible. One of the reasons for this is that, as the individual pieces become larger, the size of the chamber required to tumble such pieces increases drastically requiring a disproportionately large chamber which must be cooled to cryogenic temperatures. This causes the operating cost of the process, capital cost, and floor space required to increase to an undesirably high level. Another problem that exists with a large piece occurs when the size of the piece equals or exceeds the size of the pattern of shot being impacted on the piece. When the piece is small relative to the shot pattern, a random tumbling of the piece can be adequate to insure complete exposure of the flash to the stream of shot in the reasonable amount of time. With a relatively large piece, random tumbling may not provide adequate control of the impaction of the shot pattern on all required areas of the piece within a commercially acceptable period of time.

Another problem exists when there is a difference in density of the components, such as, for example, an automobile steering wheel having a metal hub and metal spokes but with a plastic rim. In such situation, the tumbling of steering wheels one against the other would result in at least the defacing, if not the breaking, of the plastic rim of one steering wheel when hit with the metal hub of another steering wheel.

Another problem exists when the article to be processed is heavy but has delicate or fine extremities that cannot tolerate the rugged contacting of tumbling.

Accordingly, a need has been recognized in the art for some process and apparatus whereby relatively large pieces, such as automobile steering wheels, could be subjected to the advantageous technique of cryogenic deflashing, which would insure proper exposure of the flash to the impact of the stream of shot media without resorting to the unacceptable technique of tumbling. Further, it has become desirable to effect the deflashing of such pieces in a more efficient, continuous mode rather than in a batch operation.

SUMMARY OF THE PRESENT INVENTION

This invention is directed to an apparatus for subjecting an article to shot blasting under cryogenic conditions which comprises a housing encompassing an entry station, an impacting station and an exit station. In connection with the housing, there are means provided for transporting an article to be shot blasted sequentially from the entry station, through the impacting station and then to the exit station. A connection is made to the housing permitting the introduction of a cryogen into the impacting station thereby maintaining such station at a cryogenic temperature. The apparatus also has a means for directing media at a high velocity so as to impact upon an article to be treated while such article is being transported through the impacting station. The apparatus of the invention also functions to rotate the article while it is being transported through the impacting station, thereby permitting the stream of media to contact all critical portions of the article.

In one embodiment of this inventive apparatus the housing also contains an entry port communicating between the entry station and the exterior of the housing as well as an exit port communicating between the exit station and the exterior of the housing. The conformation and relative locations of the ports and the impacting station are such that the impacting station is positioned intermediate the entry station and exit station and is also located at a lower elevation than the entry port and exit port. This conformation of the apparatus creates a "well" for containing the cryogen within the apparatus and particularly in the impacting station. Additionally, while both the entry port and exit port are both located at a higher elevation than is the impacting station, the exit port is located at a higher elevation than is the entry port. This establishes an apparatus having a conformation such that cryogen injected into the apparatus will first fill the impacting station and thereafter will rise within the apparatus until an avenue of escape is found. In the present apparatus, the first avenue of escape found by the rising cryogen will be at the entry port. This tends to establish a situation wherein cryogen injected into the apparatus will seek to escape via the lower level port, i.e. the entry port, while the movement of articles to be deflashed from the entry station, through the deflashing station and to the exit station creates somewhat of a mechanical sweeping action urging the cryogen away from the entry port. These offsetting actions tend to compensate each other. If the difference in elevation is sufficient, countercurrent flow of the cryogen relative to the movement of the articles can be established.

The particular means employed in this apparatus for directing the media to impact upon the article to be treated can be the traditional means employed in the art, e.g. a throwing wheel. Various specific designs for such device are well known in the art. Generally, such devices operate by delivering shot media to a rotating, compartmented device whereby the shot media is imparted with the angular velocity of the throwing wheel and, in a controlled manner, the centrifugal force imparted to the shot media causes it to fly out from the wheel and impact upon the article being treated. In the present apparatus it is preferably to employ a plurality of such throwing wheels for directing the shot media onto the article to be treated. More particularly, the apparatus of this invention employs rotating throwing wheels disposed so as to rotate in a horizontal plane.

As will be explained more fully later, the employment of a plurality of throwing wheels rotating in the same direction while moving the article to be deflashed through the deflashing station might tend to create a "shadow" in the throwing pattern behind the article. In order to offset this, the present invention preferably employs two throwing wheels rotating in opposite directions. To avoid any problems that might result from conflicting throwing directions of shot patterns, the rotating throwing wheels of such embodiment of the present apparatus are positioned so as to rotate in parallel planes which are displaced from each other. This tends to avoid the problems created by one wheel throwing a shot pattern directly into the shot pattern being thrown by another wheel. Additionally, the use of throwing wheels in different planes provides a greater coverage of the article by the shot patterns.

The particular means for transporting the article to be treated through the apparatus of this invention comprises a mounting rod extending through a slot in the wall of the housing. The slot traverses the entire distance that the article is to be transported through the impacting station and, preferably, the slot traverses the entire portion of the apparatus from the entry port through to the exit port. One end of this mounting rod is located within the housing and is adapted to engage an article to be treated. The other end of the mounting rod is located outside the housing and is connected to a means such as a sprocket chain, for moving the mounting rod through the impacting station. Normally, this means, such as the sprocket chain, will be employed to move the mounting rod from a point outside the apparatus into the entry station, through the impacting station and eventually to the exit station and out of the apparatus.

In the apparatus of this invention the means for rotating the article conveniently comprises means associated with the mounting rod which effects rotation of the mounting rods and which in turn results in rotation of the article engaged by the one end of the mounting rod. Conveniently, this means for rotating the article can be, for example, a wheel coaxially mounted on the mounting rod and adapted to engage at its periphery a track so that when the rod is moved through the impacting station, the coaxially mounted wheel is caused to rotate which in turn rotates the mounting rod. The particular manner whereby the coaxially mounted wheel engages a track can be through frictional engagement between the periphery of the wheel and the track or the wheel can have a series of teeth positioned about its periphery, such as a gear, which engages the track in the form of a rack.

It will be understood, of course, that in order to prevent the escape of cryogen from the apparatus, particularly from the deflashing station, it will be necessary to provide a seal along the slot through the apparatus wall which permits movement of the mounting rod, but which operates to prevent escape of cryogen. A particularly preferred type of such seal will be described more fully below in connection with the description of the attached drawings.

In order to describe this invention in greater detail, reference is made to the attached drawings.

DESCRIPTION OF THE DRAWINGS

Referring now to FIGS. 1 and 2, there can be seen front views and top views, respectively, of the apparatus of this invention suitable for shot blast deflashing and comprising an insulated housing 10 which contains the essential elements of the apparatus, especially the portions thereof maintained under cryogenic conditions.

Figure 1:
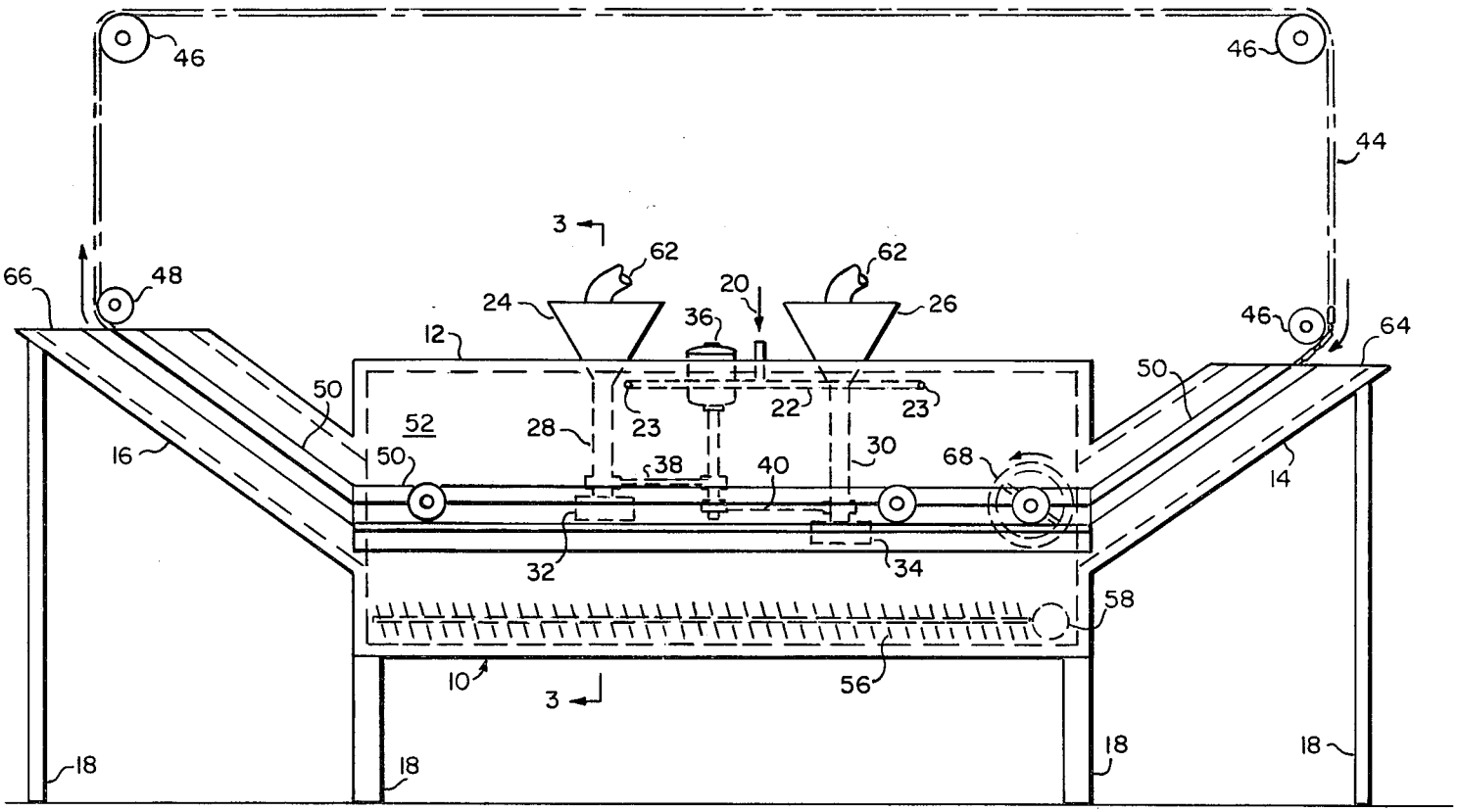
FIG. 1 is a front view of an apparatus of the present invention.

Generally, the apparatus can be described and defined as being composed of a central deflashing station or zone 12. On the right side of FIG. 1, there is shown entry tunnel 14 extending upwardly and to the right from deflashing zone 12. On the left size of FIG. 1, there is shown an exit tunnel 16 extending upwardly and to the left from deflashing zone 12. Tunnels 14 and 16 define the entry station and exit station, respectively, mentioned previously. The entire apparatus is illustrated as being positioned at a convenient height above the floor by means of support legs 18.

Associated with the deflashing zone 12, there is a cryogen inlet line 20, which connects to cryogen manifold line 22 within the deflashing zone 12 and which has two outlet ports 23. Also associated with the deflashing zone 12 are hoppers 24 and 26 for the receipt and holding of shot media prior to being transported via feedlines 28 and 30, respectively, to throwing wheels 32 and 34, respectively. It will be noticed that throwing wheels 32 and 34 are disposed so as to rotate in horizontal planes and that the throwing wheels 32 and 34 are also vertically offset, one from the other.

Figure 2:
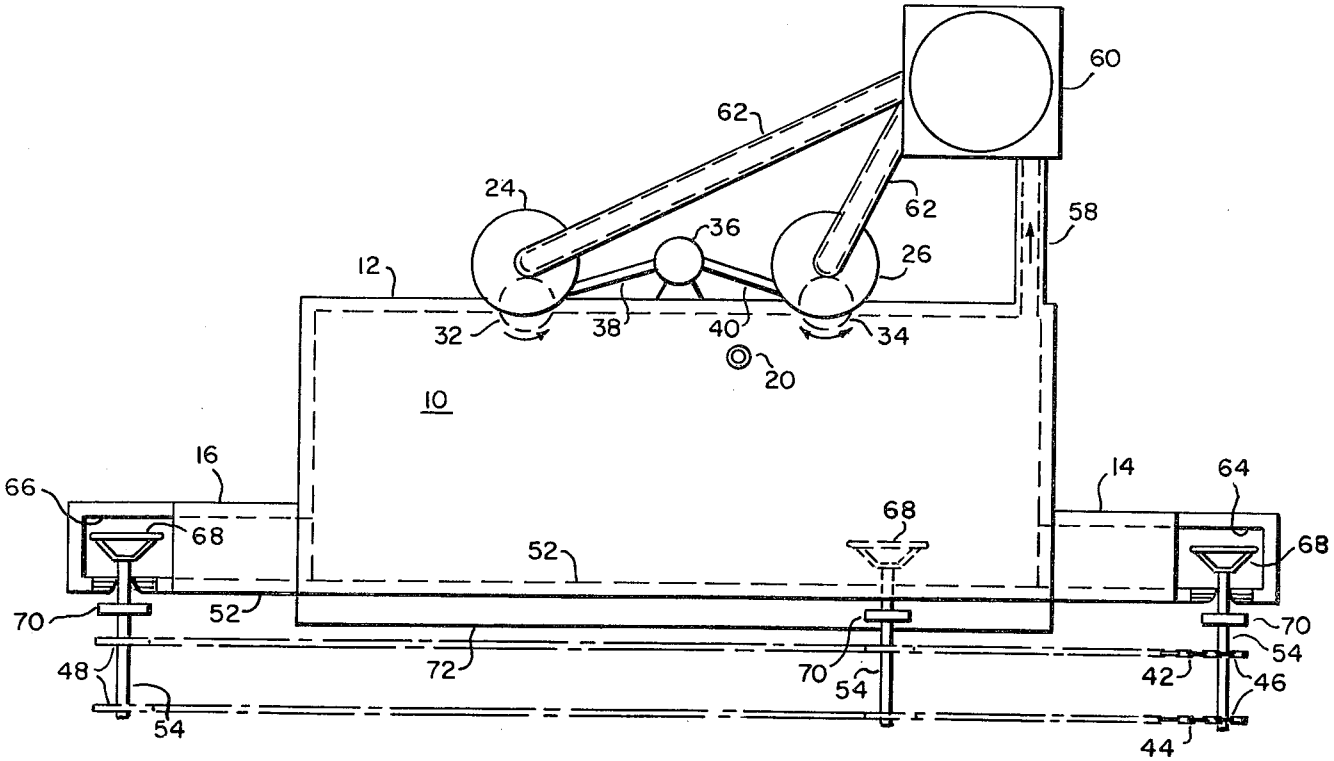
FIG. 2 is a top view of the apparatus shown in FIG. 1.

Drive Motor 36 is connected to throwing wheels 32 and 34 by means of linkages 38 and 40, respectively. In operation, shot media from hoppers 24 and 26 move vertically downward through feedlines 28 and 30, respectively, and are introduced into throwing wheels 32 and 34, respectively. As shown in FIG. 2, throwing wheels 32 and 34 are contra-rotating with throwing wheel 32 shown as rotating in a counterclockwise direction, while throwing wheel 34 is shown as rotating in a clockwise direction.

Also shown in FIGS. 1 and 2 are a pair of endless, parallel drive chains 42 and 44. These drive chains are adapted to move through congruent paths in parallel vertical planes on the same side of housing 10 with drive chain 42 being located proximate to housing 10 while drive chain 44 is located more remote from housing 10. The drive chains 42 and 44 follow an endless path about idler wheels 46 and drive wheels 48. Conveniently, the idler wheels 46 and the drive wheels 48 can be sprocket wheels designed to engage drive chains 42 and 44. The endless path through which drive chain 42 and 44 move can be described as commencing at drive wheels 48, proceeding upwardly around idler wheels 46 and thence moving clockwise and eventually paralleling entry tunnel 14, past deflashing zone 12, upwardly and to the left following the direction of exit tunnel 16 and from thence to return to drive wheels 48. Generally congruent with the path of drive chains 42 and 44 and lying in the same planes defined by the parallel drive chains 42 and 44 is a slot 50 extending through the common front wall 52 of housing 10 and tunnels 14 and 16. This permits mounting rods 54 to be engaged by drive chains 42 and 44 and to extend through slot 50 into the interior of housing 10 and tunnels 14 and 16. The particular function and method of operation of this will be explained more fully in connection with FIG. 3.

Positioned along the bottom of housing 10 is an auger 56 which is designed to transport shot media together with removed flash which has fallen to the bottom of housing 10. The auger 56 operates to move the shot-flash mixture to the right, as shown in FIG. 1, where it is removed from housing 10 via conduit 58, which in turn delivers the mixture to media separator 60. After the shot media has been separated from the pieces of removed flashing, the separated shot media are transported via supply lines 62 back to hoppers 24 and 26.

As can also be seen in FIGS. 1 and 2, the entry tunnel 14 is provided with an entry port 64, while exit tunnel 16 is provided with an exit port 66. Ports 64 and 66 are more clearly seen in FIG. 2 and provide the means of ingress and egress for pieces to be deflashed within housing 10. Referring now to FIG. 1, it will be seen that exit port 66 is disposed vertically higher than is entry port 64. It will be further noted that both of the ports 64 and 66 are also at a greater height than is deflashing station 12. This configuration of the apparatus provides a "well" within housing 10 for the collection of cryogen admitted into deflashing zone 12 through cryogen outlet port 23. Further, due to the fact that exit port 66 is at a greater elevation than is entry port 64, the flow of cryogen is from deflashing station 12 into entry tunnel 14 and thence spills out of the housing 10 through entry port 64. This ensures a positive flow of cryogen in this direction thereby precooling the articles to be deflashed as they enter the housing 10 through entry tunnel 14.

Figure 3:
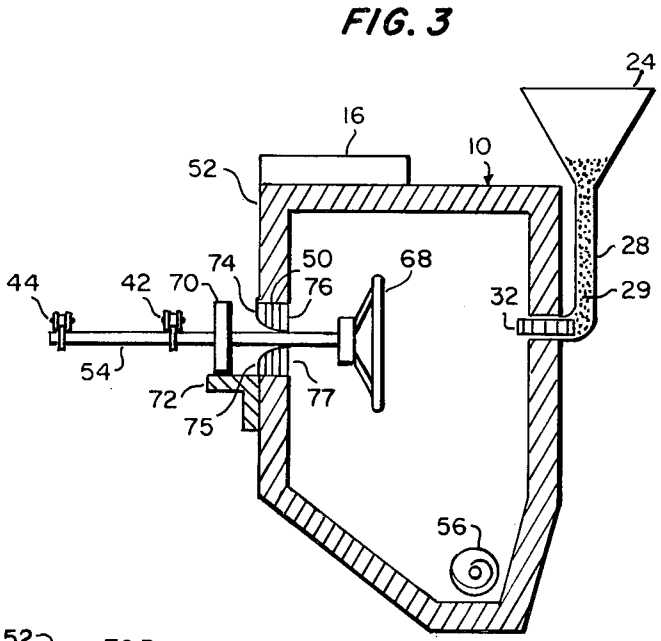
FIG. 3 is a sectional view of the apparatus taken along the line 3—3 in FIG. 1.

Other aspects of this invention are more clearly illustrated in FIG. 3, which is an enlarged cross-sectional view of deflashing zone 12 taken through hopper 24 and throwing wheel 32. In this view, feedline 28 is shown filled with shot media 29 being fed to throwing wheel 32. As is also shown in FIG. 3, the lower portion of deflashing zone 12 is comprised of converging sidewalls defining a trough-like configuration which functions to urge shot media and separated flashing toward auger 56.

More specifically, FIG. 3 illustrates a steering wheel 68 to be deflashed engaged at one end of mounting rod 54 and located within housing 10. Remote from the end of rod 54 engaging steering wheel 68 and external of housing 10, rod 54 is shown being engaged by drive chains 42 and 44. Rod 54 is further seen as passing through slot 50 in the front wall 52 of housing 10.

Also illustrated more clearly in FIG. 3 is a wheel 70 coaxially mounted on mounting rod 54 at a point thereon exterior of housing 10 and intermediate the portion of rod 54 passing through slot 50 and the portion of rod 54 engaged by drive chain 42. Located immediately below slot 50 on the exterior surface of front wall 52 is a track 72. Wheel 70 and track 72 are sized and juxtaposed such that the periphery of wheel 70 is engaged by track 72, such as by frictional engagement. Further, the engagement of rod 54 by drive chains 42 and 44 is such as to impart transverse movement to rod 54 along the length of slot 50, while permitting rotation of rod 54 about its longitudinal axis. Wheel 70, however, is rigidly mounted on rod 54 so that, as rod 54 is moved transversely along slot 50, wheel 70 is frictionally engaged by track 72 causing wheel 70 and rod 54 to which it is attached to rotate. This, in turn, effects rotation of steering wheel 68 as it moves through deflashing zone 12.

As will be understood, it is important to the efficient operation of this apparatus that some means be provided to prevent the escape of the cryogenic atmosphere from within housing 10 through the slot 50. To this end, a sealing mechanism is provided in connection with slot 50. Essentially, the seal illustrated in FIG. 3 comprises two strips of a material which is flexible at cryogenic temperatures. As shown in FIG. 3, flexible strips 74 and 75 are mounted on the exterior surface of front wall 52 immediately adjacent opposite sides of slot 50 (upper and lower sides). Each of these flexible strips 74 and 75 are of a dimension so as to extend at least half of the width of slot 50 and is at least equal to the diameter of rod 54. Each of these flexible strips 74 and 75 are flexed so as to extend inwardly into the opening of slot 50 toward the interior of housing 10 thereby presenting portions of the surfaces of strips 74 and 75 in a confronting and contacting relationship, thereby effecting a seal. Also illustrated in FIG. 3 are resilient brushes 76 and 77 disposed within slot 50 and bearing against flexible strips 74 and 75, respectively, so as to urge them into a contacting and sealing relationship.

In operation, as a mounting rod 54 moves along the length of slot 50, flexible strips 74 and 75 are urged apart, thereby permitting passage of rod 54 through slot 50. After passage of rod 54 through a particular portion of slot 50, the resilient brushes 76 and 77 urge the separated portion of flexible strips 74 and 75 back into a contacting and sealing relationship. In this manner, mounting rods 54 can pass freely along the length of slot 50, while a seal is also maintained along the length of slot 50, thereby preventing the escape of cryogen from the interior of housing 10.

Figure 4:
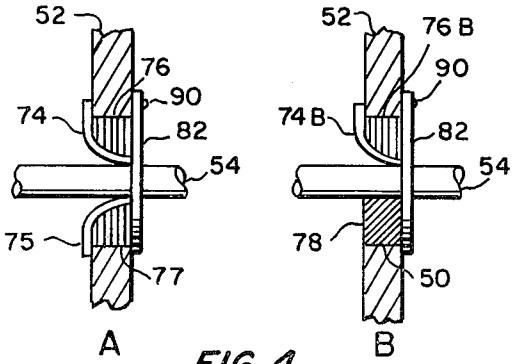
FIGS. 4A and B represent two embodiments of the sealing device employed in this invention.

This particular embodiment of the sealing means is illustrated in greater detail in FIG. 4A which is an enlarged fragmentary sectional view of the slot 50 through the side wall 52. As shown in this view, flexible strips 74 and 75 bear against the surface of mounting rod 54 and are urged into this conformation by resilient brushes 76 and 77, thus maintaining a seal about rod 54.

Figure 5:
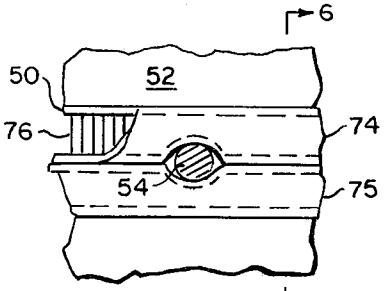
FIG. 5 is an enlarged fragmentary view of a sealing device employed in this invention.

FIG. 5 is a further illustration of this sealing mechanism as seen in a view facing front wall 52. As shown in this figure, flexible strips 74 and 75 mounted adjacent the upper and lower edges of slot 50 are urged into a confronting and contacting relationship by brushes 76 and 77, thus maintaining a seal. It will also be noted that rod 54 urges flexible strips 74 and 75 apart as rod 54 passes along slot 50.

Figure 6:
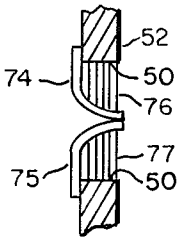
FIG. 6 is an enlarged sectional view of the sealing device of FIG. 5 taken along the line 6—6 in FIG. 5.

FIG. 6 is a further enlarged sectional view taken along the line 6—6 of FIG. 5 and generally illustrates flexible strips 74 and 75 in confronting and contacting relationship whereby a seal is effected. It will be seen that brushes 76 and 77 urge flexible strips 74 and 75 into this relationship.

Referring now to FIG. 4B, there is illustrated an alternative construction of a sealing mechanism. Much as described in conjunction with FIGS. 3, 4A, 5 and 6 there is again a flexible strip 74B attached to front wall 52 immediately above slot 50. This flexible strip 74B extends downwardly across slot 50 a length equal to at least ½ of the width of slot 50 and greater than the diameter of rod 54. As with flexible strip 74, this flexible strip 74B is also flexed so as to extend inwardly into slot 50 and bear against the upper portion of rod 54. In FIG. 4B there is no flexible strip extending from the lower side of slot 50, but, rather, positioned along the lower edge of slot 50 is a low friction gasket 78 designed to contact rod 54 from underneath and maintain a sealing relationship with such rod 54.

Figure 7:
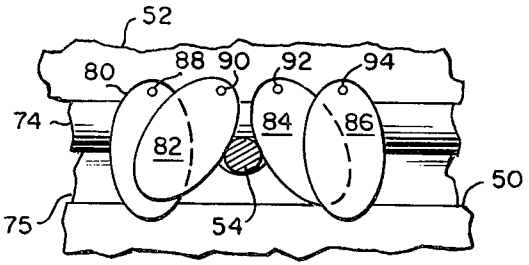
FIG. 7 represents shielding means for protecting the sealing device of FIG. 4 from injury by the high velocity shot media.

Referring now to FIG. 7 there is illustrated a further embodiment of this invention where flexible strips 74 and 75 are provided with a shielding means to protect them from excessive impact by the high velocity stream of the deflashing media. As shown in FIG. 7, a series of eccentric pendulum shields functioning as individually pivotting shutters are placed in a protecting relationship adjacent slot 50. While in actual operation these shields extend through the entire length of slot 50 within the flashing zone 12, for purposes of illustration only four of such pendulum shields 80, 82, 84, and 86 are shown. These pendulum shields are rotatably mounted to the interior surface of front wall 52 immediately above slot 50 by means of mounting pins 88, 90, 92 and 94, respectively. These shields are mounted along the length of slot 50 in an overlapping relationship so that they normally overlie and cover flexible strips 74 and 75. As a mounting rod 54 moves transversely along the length of slot 50 and contacts a pendulum shield, the shield pivots about its mounting pin and is moved out of the path of rod 54. As illustrated in FIG. 7, a mounting rod 54 is moving in the direction from left to right and is shown to be causing pendulum shield 84 to pivot about mounting pin 92 and rotate up in a counterclockwise direction out of the path of rod 54. As also illustrated rod 54 has already passed beneath the mounting pin 90 in pendulum shield 82 and, thus, pendulum shield 82 is now rotating downwardly bearing against rod 54 as rod 54 moves to the right, thus permitting shield 82 to rotate back into a position protecting flexible strips 74 and 75.

Figure 8:
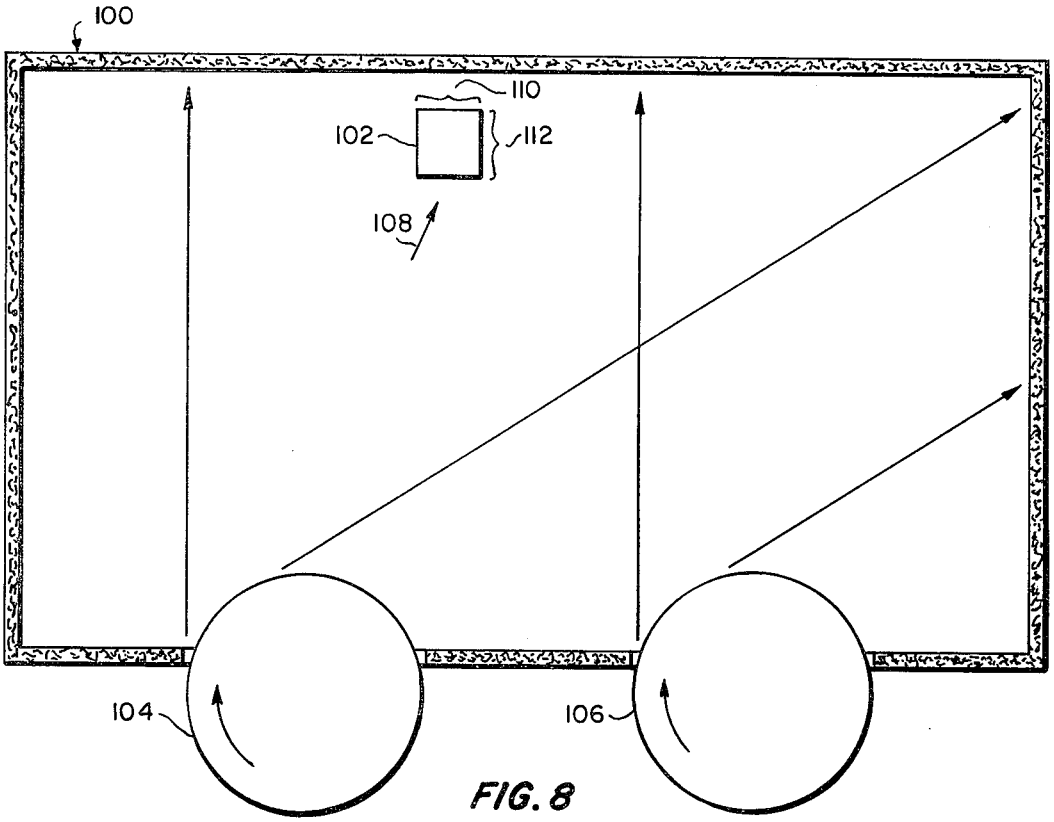
FIG. 8 illustrates the effect of employing two throwing wheels rotating in the same direction.
Figure 9:
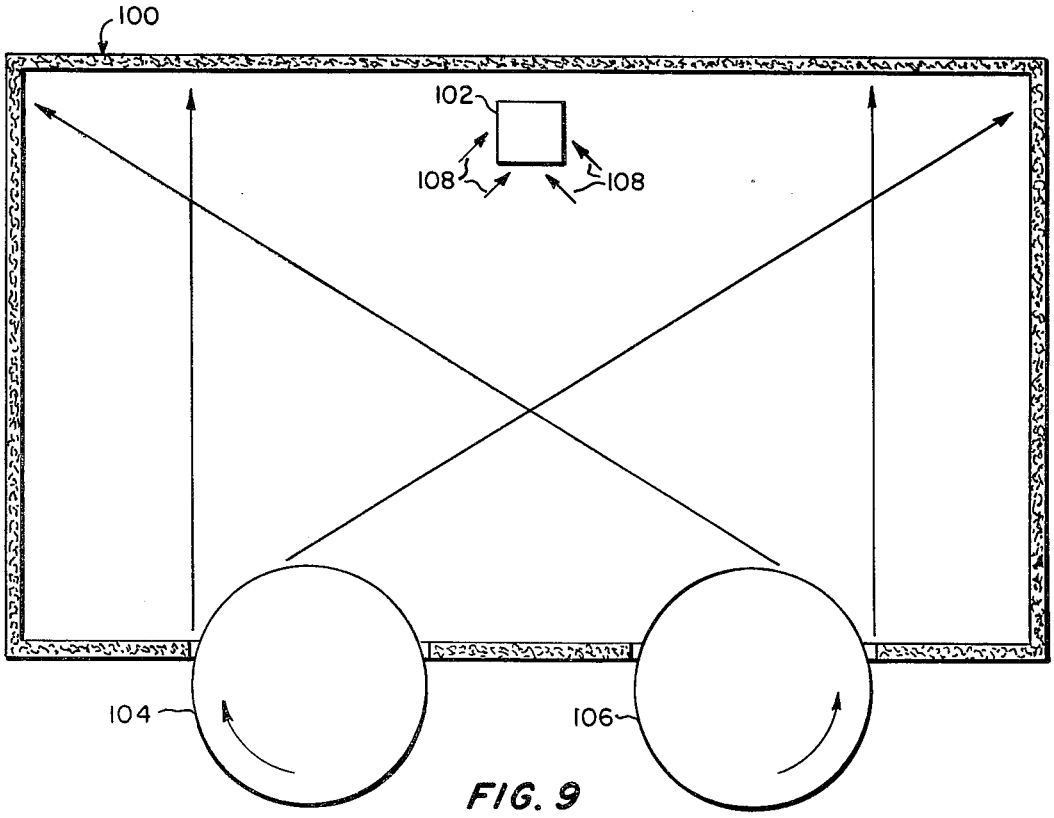
FIG. 9 represents the advantages to be gained by employing contra-rotating throwing wheels.

FIGS. 8 and 9 are presented to illustrate one of the advantages to be obtained by the employment of contra-rotating throwing wheels. In FIG. 8 there is illustrated an insulated housing 100 enclosing a deflashing zone. Toward one side of housing 110 is located an article 102 to be shot blasted. On the side of housing 100 opposite article 102 are located throwing wheels 104 and 106. In FIG. 8 both throwing wheels 104 and 106 are illustrated as rotating in a clockwise direction. Associated with each of throwing wheels 104 and 106 are two tangential lines indicating the direction in which the shot media are thrown by each of the wheels. Shot being thrown in such patterns tends to produce a resultant approximated by the arrow 108. As will be understood this leaves substantial portions of the article 102 in a "shadow" substantially untouched by the stream of high velocity media. These surfaces in "shadow" are indicated by brackets 110 and 112 in FIG. 8.

In FIG. 9 there is illustrated the same housing 100 and an article to be shotblasted 102. Similarly there can be seen throwing wheels 104 and 106. As illustrated in FIG. 9, however, the throwing wheels are contra-rotating with throwing wheel 104 rotating in a clockwise direction, while throwing wheel 106 rotates in a counterclockwise direction. This results in the streams of shot media from the two throwing wheels impacting upon article 102 from opposite sides, as illustrated by arrows 108. This results in a substantial reduction in the portion of article 102 remaining in "shadow."

What is claimed is:

1. An apparatus for cryogenically shot blasting an article which comprises a housing including an entry station, an entry port communicating between the entry station and the exterior of the housing, an impacting station, an exit station, and an exit port communicating between the exit station and the exterior of the housing, the exit port being at a greater vertical elevation than the entry port and both the entry port and the exit port being at a greater vertical elevation than the impacting station, means for introducing a cryogen into the housing, means for transporting an article to be treated sequentially from the entry station, through the impacting station and to the exit station, means for directing media at high velocity to impact upon an article being transported through the impacting station, and means for rotating the article while being transported through the impacting station, said impacting station being maintained at a cryogenic temperature.

2. The apparatus of claim 1 wherein the means for directing media to impact upon the article comprises a rotating throwing wheel.

3. The apparatus of claim 1 wherein the means for directing media comprises a plurality of rotating throwing wheels.

4. The apparatus of claim 3 wherein each throwing wheel is positioned so as to rotate in a horizontal plane.

5. The apparatus of claim 3 wherein there are two throwing wheels and each wheel rotates in a separate plane.

6. The apparatus of claim 3 wherein each of the wheels rotates in a direction opposite to that of the other.

7. The apparatus of claim 1 wherein the means for transporting an article to be treated comprises a mounting rod extending through a slot in the housing, said slot traversing the entire distance the article is to be transported through the impacting station, one end of the mounting rod being disposed within the housing and adapted to engage an article to be treated, the other end of the mounting rod being disposed without the housing and operably cooperating with motive means for moving the mounting rod through the deflashing station.

8. The apparatus of claim 7 wherein the means for rotating an article comprises means associated with the mounting rod effecting rotation of the mounting rod about the axis of the rod as it is moved through the impacting station.

9. The apparatus of claim 7 wherein the means for rotating an article comprises a wheel coaxially mounted on the mounting rod and adapted to engage at its periphery a track positioned parallel to the slot; whereby movement of the rod through the impacting station causes rotation of the wheel and the rod on which it is mounted, thus resulting in rotation of the article engaged by the one end of the rod.

10. The apparatus of claim 7 wherein the motive means comprises a pair of spaced apart drive chains adapted to move synchronously through parallel planes in paths congruent to each other, the parallel planes being disposed perpendicular to the desired plane through which the rod moves through the impacting station, thereby insuring the movement of the mounting rod in the desired plane through the impacting station without rotation of the rod but permitting revolution of the rod about its axis.

11. The application of claim 7 which also includes sealing means associated with the slot for preventing escape of cryogen from within the housing while permitting movement of the mounting rod traversely along the length of the slot, said sealing means comprising a pair of elongated strips flexible at cryogenic temperature each affixed along one longitudinal edge to opposite sides of the slot, the width of each elongated strip being greater than one-half the size of the width of the slot and greater than the largest cross-sectional dimension of the mounting rod, the strips being disposed in a flexed manner such that the other longitudinal edge of each strip extends into the slot and at least a portion of the traverse surface of each strip is in a confronting relationship with at least a portion of the transverse surface of the other strip, the confronting portions of the strips normally being in sealing contact with each other, the mounting rod operable to urge the confronting portions of the strips apart from each other where the rod is in sealing contact with the strips, and means resilient at cryogenic temperature urging the strips into sealing contact with each other.

* * * * *